US005769413A

United States Patent [19]

Hummel et al.

[11] Patent Number: 5,769,413

[45] Date of Patent: Jun. 23, 1998

[54] PROCESS AND APPARATUS FOR AUTOMATIC STACK CHANGING

[75] Inventors: Peter Hummel, Offenbach; Robert Ortner, Alzenau, both of Germany

[73] Assignee: MAN Roland Druckmaschinen AG, Germany

[21] Appl. No.: 801,057

[22] Filed: Feb. 14, 1997

[30] Foreign Application Priority Data

Feb. 14, 1996 [DE] Germany ..... 196 05 322.6

[51] Int. Cl.[6] ..... B65H 31/10

[52] U.S. Cl. ..... 271/218; 271/213

[58] Field of Search ..... 101/232; 271/218, 271/213

[56] References Cited

U.S. PATENT DOCUMENTS

| | | | |
|---|---|---|---|
| 4,508,333 | 4/1985 | Byrt | 271/218 |
| 4,934,687 | 6/1990 | Hayden et al. | 271/202 |
| 5,002,456 | 3/1991 | Gosslinghoff | 271/218 |
| 5,322,272 | 6/1994 | Benz et al. | 271/218 |
| 5,368,288 | 11/1994 | Philipp et al. | 271/215 |

FOREIGN PATENT DOCUMENTS

| | | | |
|---|---|---|---|
| 3122451C2 | 2/1985 | Germany . | |
| 4131015A1 | 4/1993 | Germany . | |
| 4217816A1 | 12/1993 | Germany . | |
| 4131015C2 | 10/1995 | Germany . | |
| 5-147807 | 6/1993 | Japan | 271/218 |

*Primary Examiner*—Edgar S. Burr
*Assistant Examiner*—Daniel J. Colilla
*Attorney, Agent, or Firm*—Leydig, Voit & Mayer, Ltd.

[57] ABSTRACT

A process and apparatus for automatically changing the stack of sheets in a sheet-fed printing machine is disclosed comprising sheet-carrying surfaces, sheet-separating devices, a pallet, sensors and a control system. The sheet-carrying surfaces act in concert with the sheet-separating devices to create an auxiliary stack separate from the existing stack of printed sheets. In this manner, the existing stack of sheets are removed and the auxiliary stack is deposited on a new stack base as brief and as closely coordinated as possible. The timing of the transition from the sheet-separating devices to the sheet-carrying surfaces is coordinated such that, even in the case of thin printing materials, the stack changing apparatus functions properly during the stack-changing process.

16 Claims, 11 Drawing Sheets

PROCESS AND APPARATUS FOR AUTOMATIC STACK CHANGING

FIELD OF THE INVENTION

The invention relates generally to printing machines and more particularly to a process and apparatus for the automatic changing of a delivery stack for a printing machine.

BACKGROUND OF THE INVENTION

Automatic stack changing is an important aspect for the printing of sheets in a sheet-fed printing machine. Stacks of sheets are handled both at a sheet-delivery means and at a sheet feeder. In particular, in the region of a sheet-delivery means of a sheet-fed rotary printing machine, the printed sheets arrive at high speed, have to be intercepted for a transition period, and then deposited. For intercepting and retaining in the interim, these printed sheets arrive in a free-floating manner and are subjected only to slight braking. In processing these printed sheets in the region of the sheet feeder, one must take into account the different characteristics of the printed sheets as opposed to the untreated, not-yet printed printing material, e.g. paper. The already printed sheet may no longer have its originally smooth contour. Furthermore, a printed sheet may be heavier, corrugated and carry a layer of ink which may not be fully dry.

German Patent 4,131,015 discloses a sheet-delivery means having a main-stack lift and an auxiliary-stack lift. The auxiliary-stack lift contains sheet-carrying surfaces and sheet-separating devices. In automatically changing the full stack of sheets, the sheet-separating devices, which are arranged on the transverse side of the sheet delivery means, are thrust at high speed into the region of the printed sheets which have been released by an endless chain conveyor and are falling downwards. The sheet-separating devices thereby create a gap in the region of the continuously supplied printed sheets. Further, the printed sheets held-up by the sheet-separating devices provide a gap for the insertion of laterally arranged sheet-carrying surfaces held on standby outside the region of the delivery stack. The sheet-carrying surfaces serve as carriers for an auxiliary stack which is supported while the pallet containing the full stack of sheets is removed from the sheet-delivery means and an empty pallet is inserted. While the sheet-separating devices hold up the incoming printed sheets laterally, the sheet-carrying surfaces are inserted into the region of the delivery stack and thereby receive the printed sheets from the sheet-separating devices. The sheet-separating devices are then drawn back once the sheet-carrying surfaces have been inserted to their fullest extension, so that the stacked-up printed sheets are then deposited on the sheet-carrying surfaces.

When changing a stack of sheets which is of a somewhat thinner printing material, the stack of sheets stacked on the sheet-separating devices may become marked in the region where the sheet-separating devices rest. This is due to the relatively narrow design of the sheet-separating devices, which allows for insertion into a gap between sheets. Often, the ink on the printed sheets is smeared onto the printed sheet lying on top in each case, or onto the reverse side thereof. Moreover, the printed sheets may be displaced as a result of their resting on the sheet-separating devices. This may result in problems in forming the auxiliary stack and in the printed sheets being pushed together, i.e. folded in toward the center of the stack of sheets.

OBJECTS OF THE INVENTION

It is thus a primary aim of the present invention to provide an improved apparatus and method for exchanging a stack of sheets on a sheet-delivery means.

In accordance with that aim, it is a primary object of the invention to provide a stack-changing procedure on a sheet-delivery means that is more reliable and, as far as the quality of printing materials is concerned, can be used more widely.

It is a further object of the invention to provide a stack-changing procedure and apparatus which allows for more quickly changing the delivery stack.

It is a still a further object of the invention to provide a stack-changing procedure and apparatus which is capable of processing lower quality or thinner paper.

It is yet still a further object of the invention to provide a stack-changing procedure and apparatus which does not remove the ink from the printed sheets.

It is even still a further object of the invention to provide a stack-changing procedure and apparatus which does push together the printed sheets during insertion of the sheet-carrying surfaces.

SUMMARY OF THE INVENTION

In accordance with the objects stated above and other objects and other advantages of the present invention, a stack-changing procedure and apparatus is provided in the form of a sheet delivery means and an auxiliary stack device which is comprised of at least two sheet-separating devices and at least two sheet-carrying surfaces. The incoming sheets on the sheet-delivery means are not subjected to such severe stress due to the coordinated operations of the sheet-separating devices, the sheet-carrying surfaces, and the main stack lift. Due to a combination of speeding up and slowing down the main stack lift, timing the thrusting of the sheet-separating devices, and timing of insertion of the sheet-carrying surfaces, the auxiliary stack is not subjected to undue stress during operation. Through these coordinated operations, it is therefore possible to use the proposed stack-changing apparatus to process lower-quality paper, i.e. thinner paper, avoiding rejects from being produced. Furthermore, the new design allows very much quicker movement, so that the auxiliary stack which is formed on the separating devices comprises only a small number of printed sheets. As a result of this, moreover, the entire process can be carried out more quickly.

DETAILED DESCRIPTION OF A PREFERRED EMBODIMENT

While the invention will be described with reference to the preferred embodiments, it will be obvious to those of ordinary skill in the art that variations of these preferred embodiments may be used and it is intended that the invention may be practice otherwise than as specifically described herein. Accordingly this invention includes all modifications and equivalents encompassed within the spirit and scope of the invention as defined by the appended claims.

Figure 1:
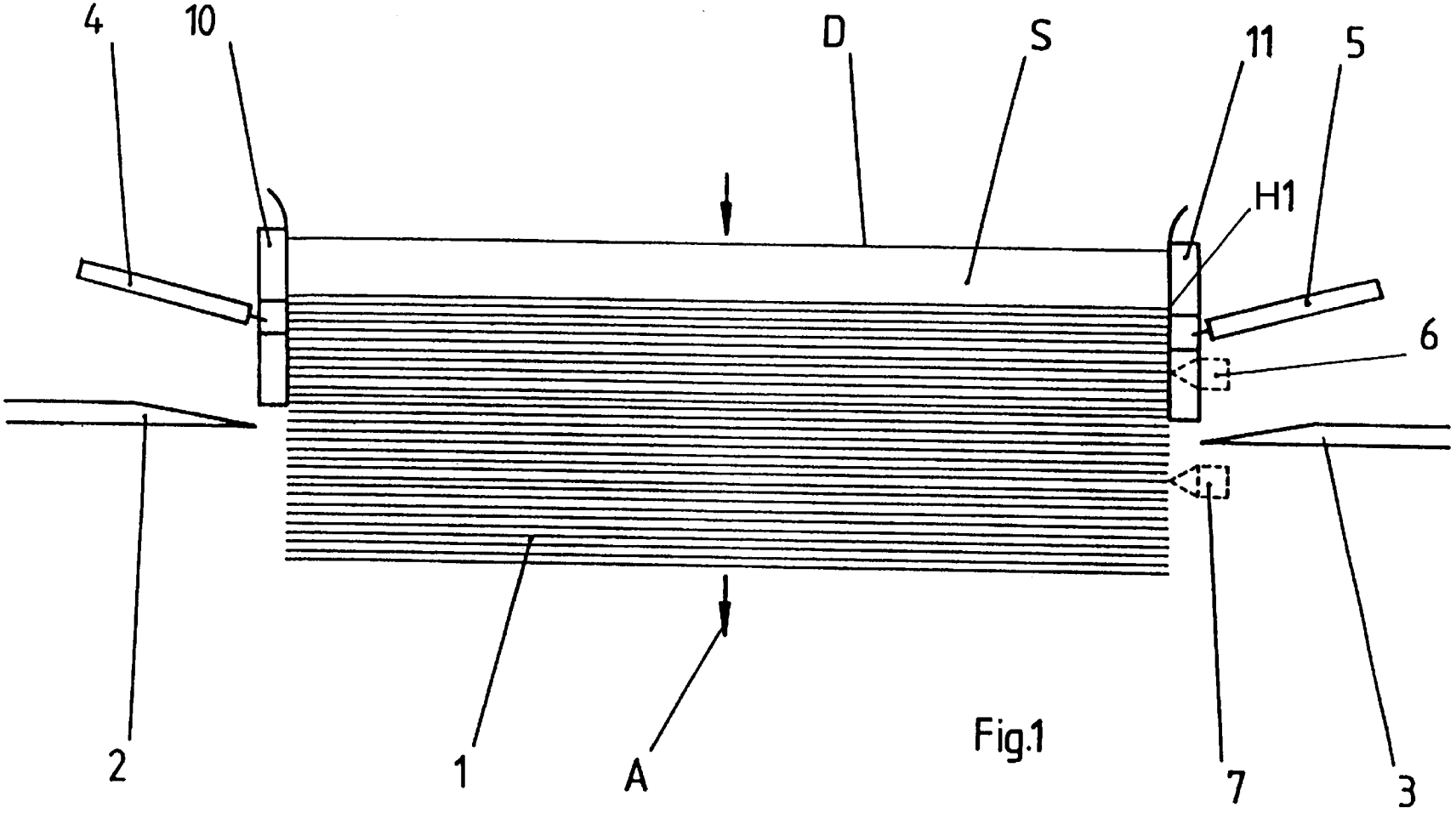
FIG. 1 shows the front elevation view of the stack-changing apparatus according to an embodiment of the invention.

Referring now more particularly to FIG. 1, there is shown a stack-changing apparatus on a sheet-delivery means of a sheet-fed printing machine having devices required for so-called non-stop operation. In this case, the sheet-delivery means, only part of which is illustrated here includes an appropriate endless chain conveying system (not illustrated) and a main-stack lifting mechanism 13, so that printed sheets D can be conveyed from the printing mechanisms of the sheet-fed printing machine to the sheet-delivery means, released above a stacking region S, and deposited. For this purpose, the printed sheets D are braked and, in free-fall, deposited on a stack of sheets 1. The stack of sheets 1 is seated on a pallet which, in turn, is carried by a main-stack lifting mechanism 13. The main-stack lifting mechanism 13 ensures continuous lowering of the pallet as the stack of sheets 1 is increased by the printed sheets D which are conveyed to it and deposited on it. An auxiliary-stack device is arranged on both sides of the region of the stack of sheets 1, level with the stacking region S. The auxiliary-stack device comprises two mirror-inverted sheet-carrying surfaces 2, 3 which are arranged on the sheet-delivery means from the transverse sides, i.e. at right angles to a sheet-running direction predetermined by the sheet-fed printing machine. The sheet-carrying surfaces 2, 3 can each be moved into the stacking region S, and out of the same, with the aid of a drive. Two sheet-separating devices 4, 5 are respectively arranged on both sides of the stack of sheets 1, these sheet-separating devices 4, 5 being assigned to the sheet-carrying surfaces 2, 3, above the latter, and thus also to the stacking region S. The sheet-separating devices 4, 5 comprise small pneumatic cylinders, on the operating cylinders of which there are arranged pins which can be inserted into the stacking region S. Furthermore, the orientation of the sheet-separating devices 4, 5 is slanted slightly with respect to the position of the incoming printed sheets D, this resulting in a downwardly curved bearing surface of the incoming printed sheets D as the sheet-separating devices 4, 5 are being inserted. Furthermore, control system 14 is connected to the sheet-delivery means, and the control system 14 controls the operations of moving the above-described sheet-carrying surfaces 2, 3, sheet-separating devices 4, 5 and main stack lifting mechanism 13 with respect to one another.

Figure 9A:
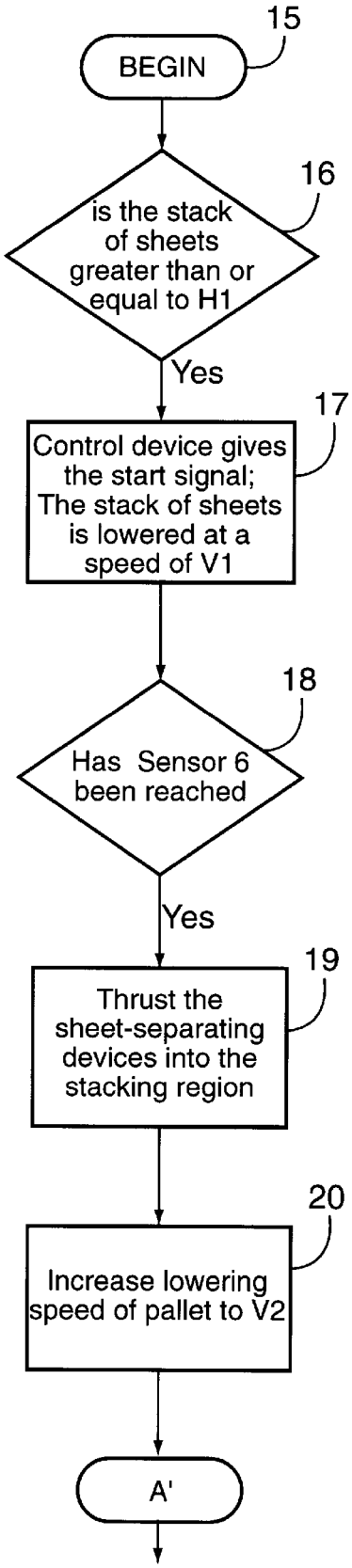
FIGS. 9A and 9B show a flow diagram of the stack-changing apparatus.
Figure 10:
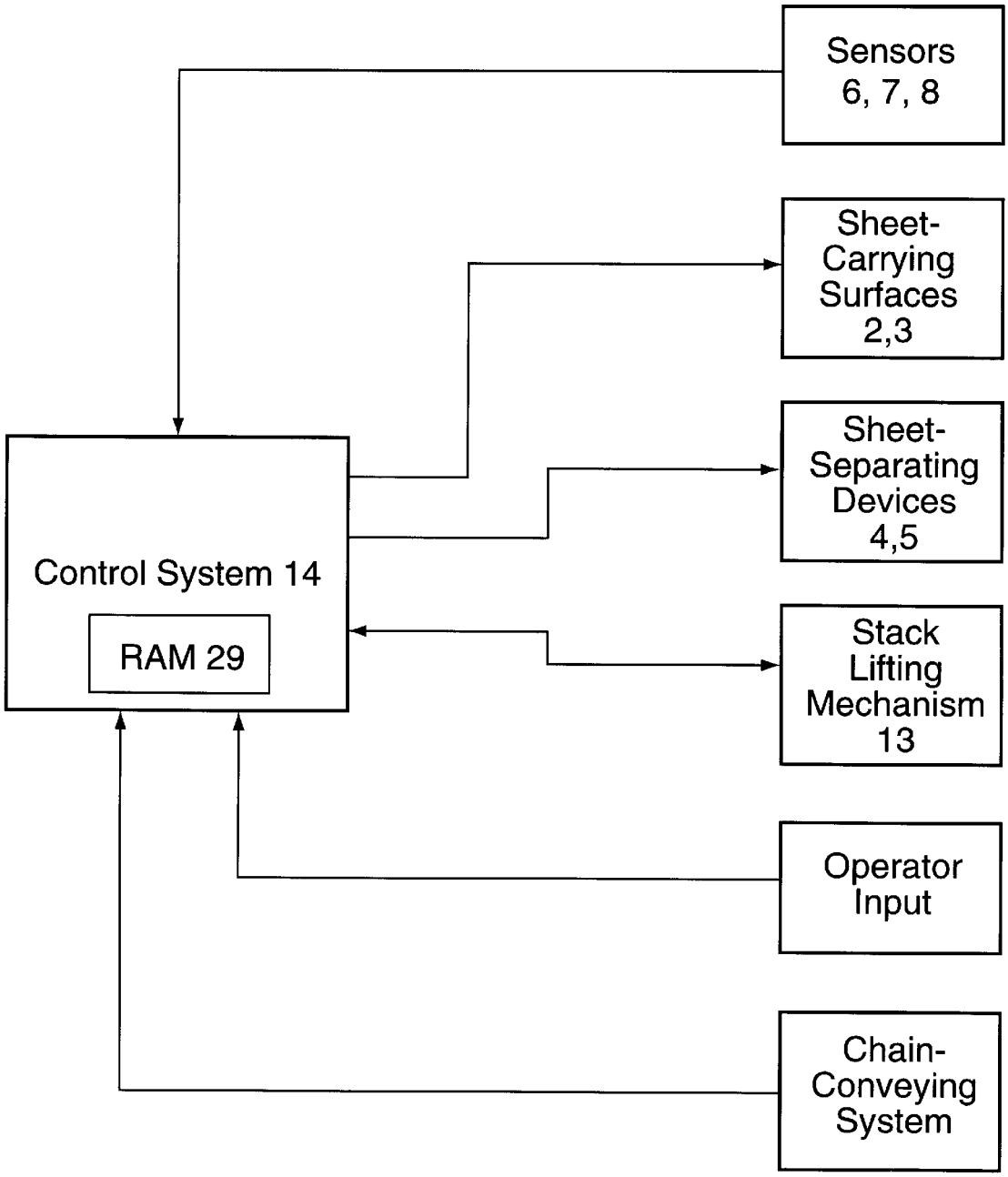
FIG. 10 shows a block diagram of the stack-changing apparatus.

The sheet-separating devices 4, 5 are arranged in the region of lateral guides 10, 11 which serve for a precise formation of the stack of sheets 1. For the purpose of treating the printed sheets D quickly and carefully during the stack-changing process, the following sequence of operations is thus envisaged:

FIG. 1 shows the initial state of the stack of sheets 1 in the sheet-delivery means. The stack of sheets 1 has been filled virtually up to its maximum stack height, the sheet-carrying surfaces 2, 3 are in the standby position and the sheet-separating devices 4, 5 are in the standby position. Once a specific height H1 of the stack of sheets 1 has been reached, (the specific height H1 can be derived, for example, from the position of the main-stack lifting mechanism 13), the control system 14 gives the start signal, as shown in the block diagram of FIG. 10. The flow diagram at 15, as shown in FIG. 9A, also describes the sequence of the stack changing apparatus. However, the printer or operator may also trigger this signal by hand when he deems it appropriate. The starting signal results in the stack of sheets 1 being lowered in the direction A. The lowering movement takes place at a relatively slow lowering speed V1, in order not to disturb the stack formation too greatly, as shown at 16 in FIG. 9A.

Figure 2:
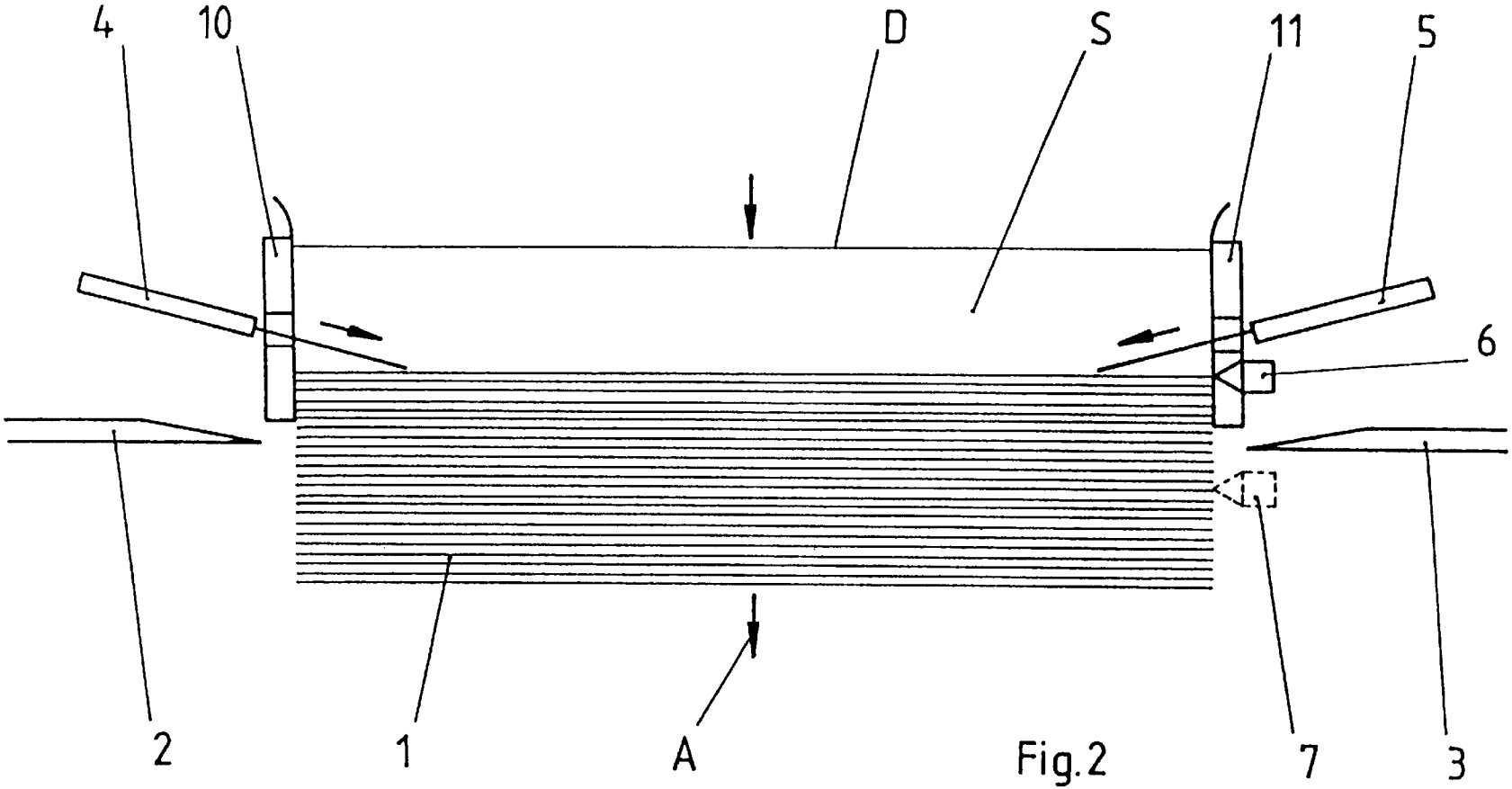
FIGS. 2–6 show successive phases of the front elevation view of the stack-changing apparatus.

FIG. 2 illustrates the second step of the stack-changing process. Once a sensor 6 has been reached, during the downwards movement of the stack of sheets 1, the sheet-separating devices 4, 5 are thrust into the region of the falling printed sheets D, as shown at 17, 18 in FIG. 9A. This operation is controlled in relation to the functions of the printing machine such that the sheet-separating device 4, 5 have to be thrust in at a point in time at which there is a gap between the falling printed sheets D. This control operation has to be coordinated, for example, with the movement of the chain-conveying system, as shown in the block diagram of FIG. 10, or can be derived therefrom. Once the sheet-separating devices 4, 5 have been thrust in, the lowering speed is increased to the value V2 in order for the upper edge of the stack of sheets 1 to reach the region of the sheet-carrying surfaces 2, 3 more quickly, as shown at 20 in FIG. 9A.

Figure 3:
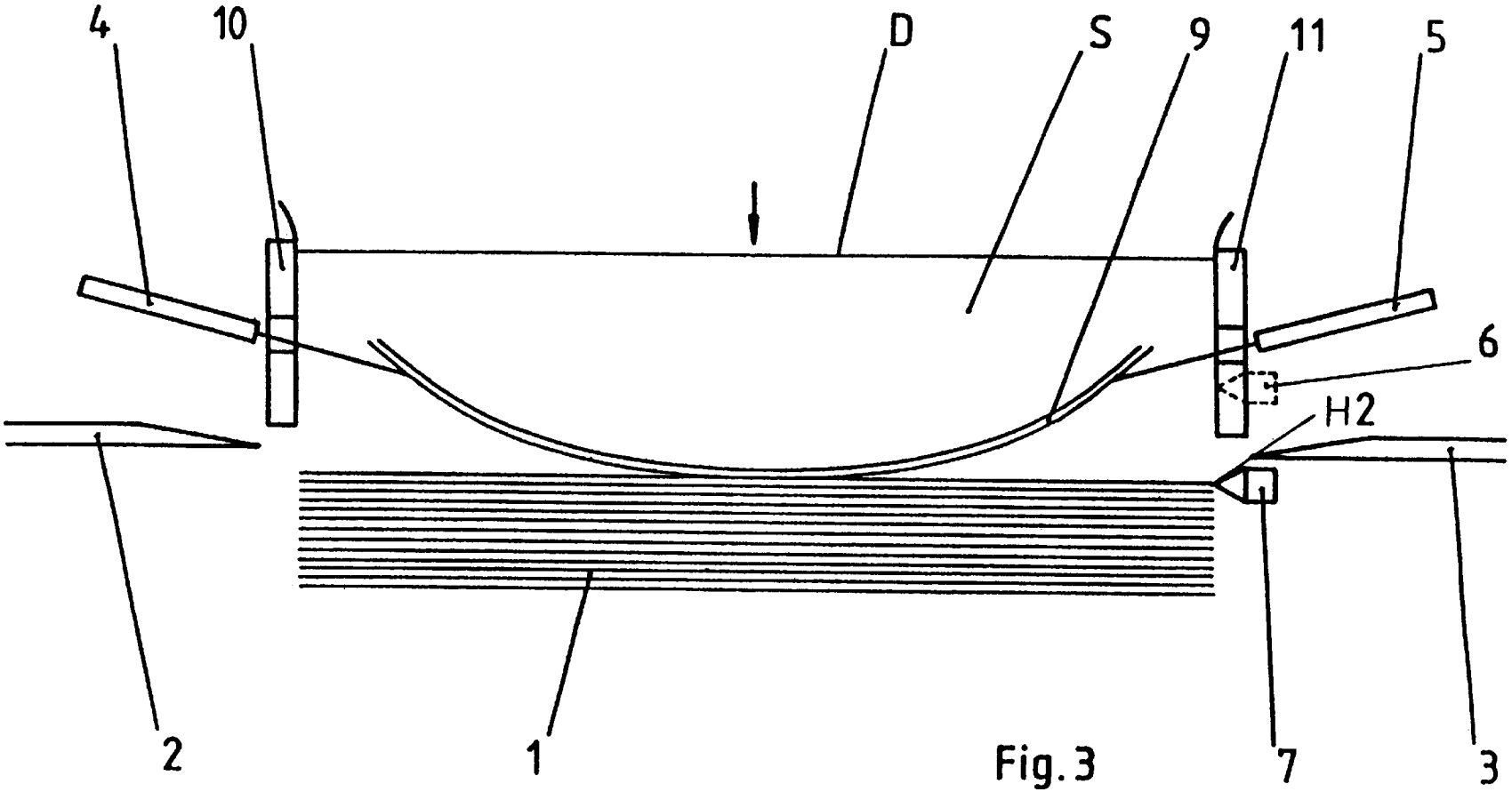
Figure 9B:
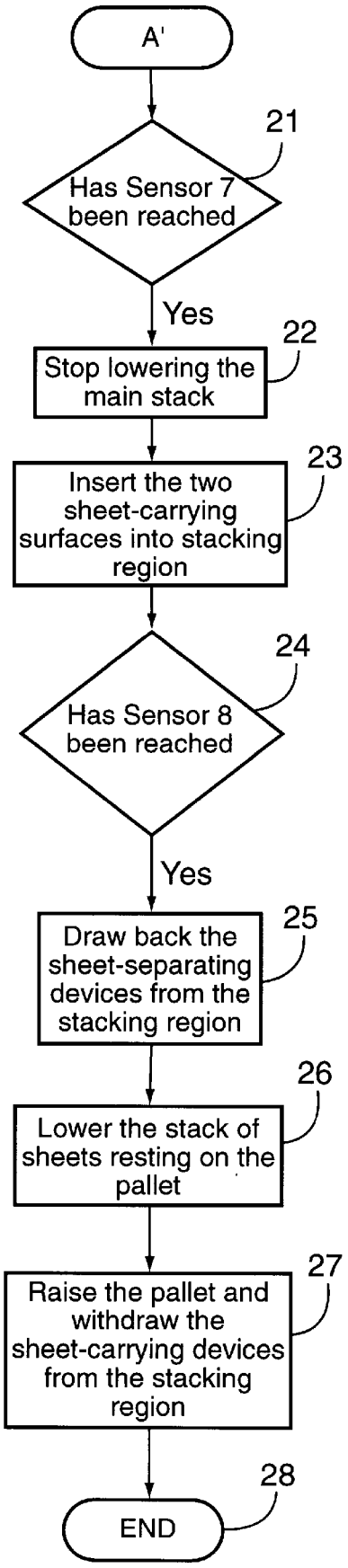

FIG. 3 shows the third step of the stack-changing process. It is illustrated here that, in the meantime, two printed sheets D have been deposited on the sheet-separating devices 4, 5 so that there is a primary stack of sheets resting on the pallet and an auxiliary stack of sheets resting on the sheet-separating devices 4, 5. The sheets rest in an accurate manner with their central part on the surface of the stack of sheets 1. Meanwhile, the movement for lowering the main stack has been stopped upon reaching a second sensor 7, at a height H2, as shown at 21, 22 in FIG. 9B. The position corresponding to height H2 can also be derived from the movement of the main-stack lifting mechanism 13, and approached, so that a device in the drive of the main-stack lifting mechanism 13 may be used as the sensor. At this defined point in time, the insertion movement of the sheet-carrying surfaces 2, 3 in the direction of the stack of sheets 1 is commenced, as shown at 23 in FIG. 9B. This causes the two sheet-carrying surfaces 2, 3 to move into the stacking region S, above the stack of sheets 1, from the side edges. By virtue of the lateral guides 10, 11 arranged above the sheet-carrying surfaces 2, 3, the falling printed sheets D are also well aligned as they are deposited on the sheet-separating devices 4, 5.

Figure 4:
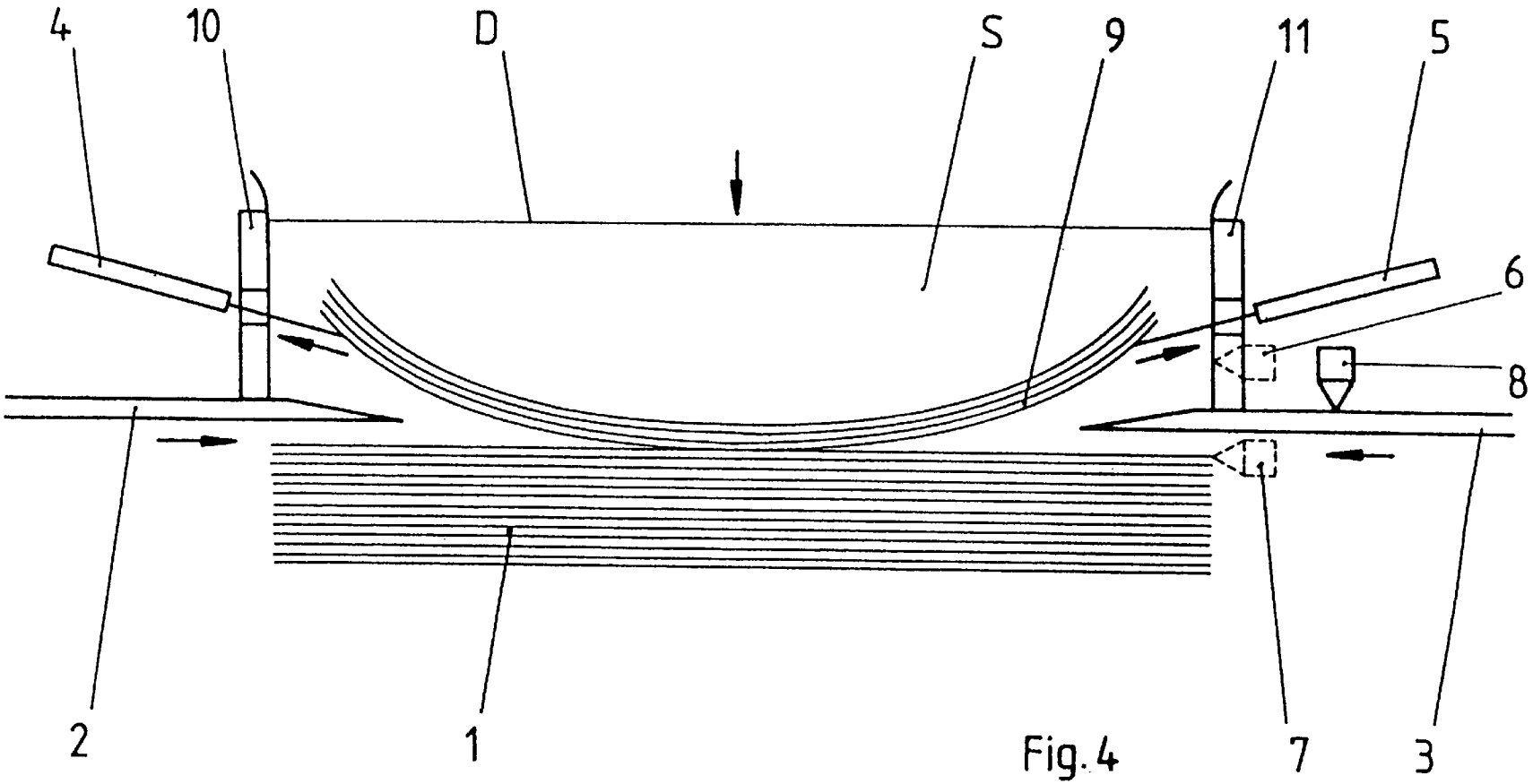
Figure 8:
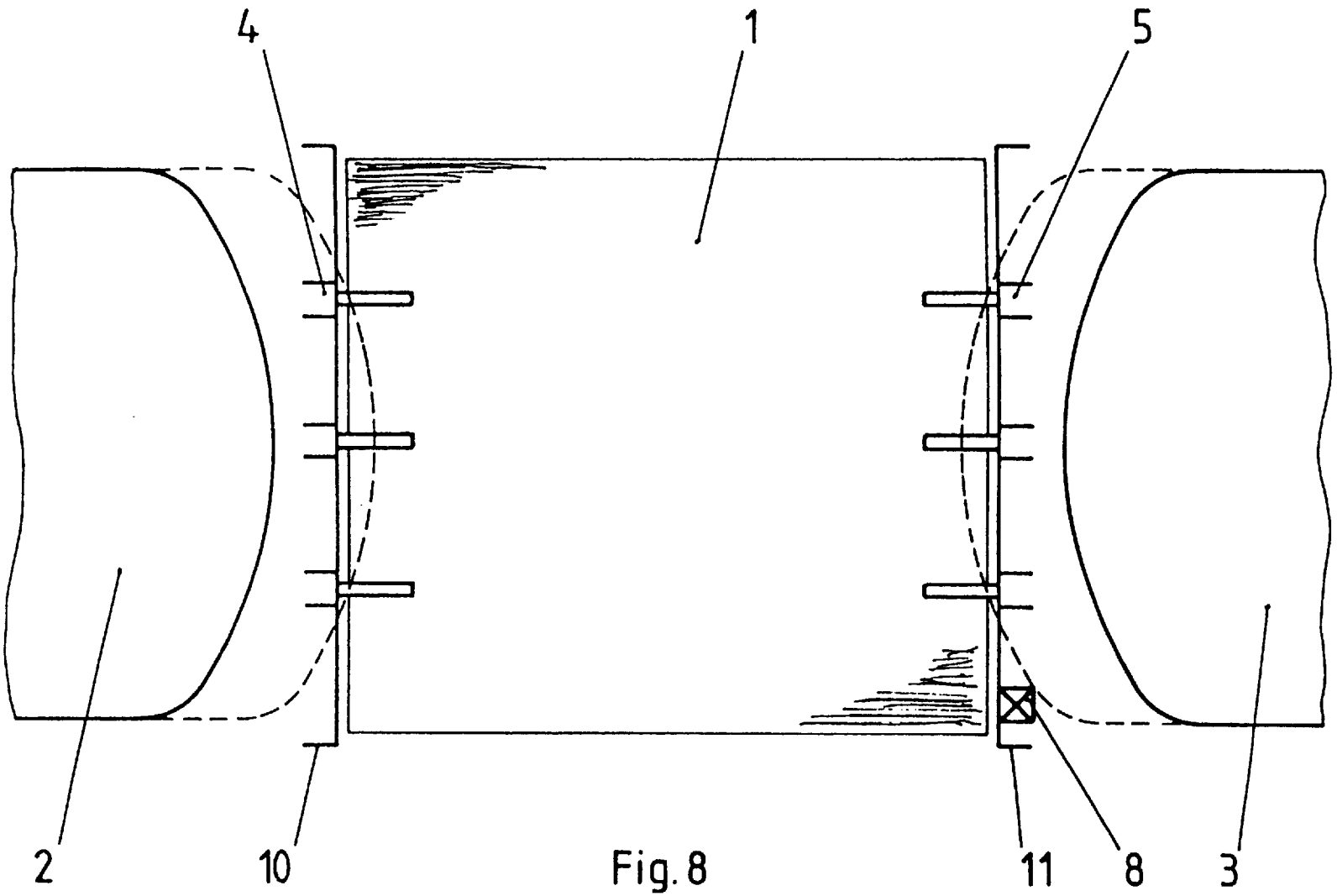
FIG. 8 shows a plan view of the arrangement of the stack-changing apparatus in the delivery means.

FIG. 4 shows the fourth step of the stack-changing process. In the meantime, further printed sheets have been deposited on the sheet-separating devices 4, 5. The change in the movement between the sheet-separating devices 4, 5 and the sheet-carrying surfaces 2, 3 is illustrated as shown by the arrows in FIG. 4. As the insertion of the sheet carrying surfaces 2, 3 into the region of the stack of sheets 1 continues, these surfaces 2, 3 reach a third sensor 8 which is placed adjacent to the stacking region S. The sensor 8 is arranged such that it registers the position of the sheet-carrying surfaces 2, 3 for the first time when the sheet-carrying surfaces 2, 3 have already been inserted some way into the stacking region S, as shown at 24 in FIG. 9B. The sensor 8 may also register the position of the sheet-carrying surfaces 2, 3 when the sheet-carrying surfaces 2, 3 are withdrawn from the stacking region S, as discussed below. One embodiment of using sensor 8 to detect the position of the sheet-carrying surfaces 2, 3 is illustrated in FIG. 8. During the changeover in movements between the sheet-carrying surfaces 2, 3 and the sheet-separating devices 4, 5, an auxiliary stack 9 continues to be formed on the sheet-carrying surfaces 2, 3.

Figure 5:
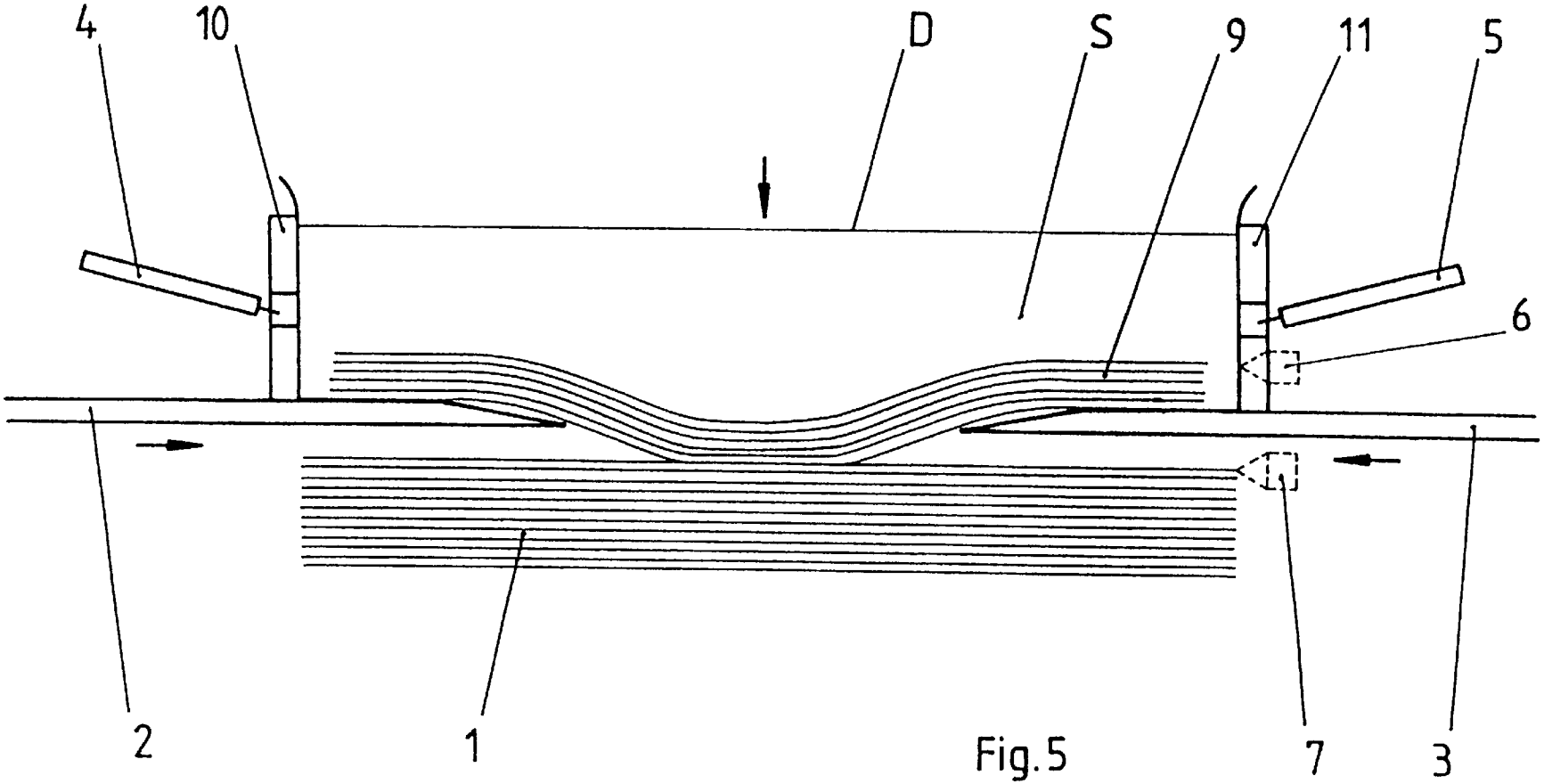

FIG. 5 shows the fifth step of the stack-changing process. The printed sheets D of the auxiliary stack 9 contain a relatively small number of said sheets which have been deposited by this point in time. Once the sheet-separating devices 4, 5 have been drawn back, the printed sheets D of the auxiliary stack 9 fall onto the front ends of the sheet-carrying surfaces 2, 3 being inserted into the stacking region S, as shown at 25 in FIG. 9B. Since the sheet-carrying surfaces 2, 3 are arranged very closely above the surface of the still-present stack of sheets 1, the printed sheets D of the auxiliary stack 9 only sag downwards to a small extent as the ends of the sheet-carrying surfaces 2, 3 approach one another. Thus, even when the printed sheets D only rest partially on the sheet-carrying surfaces 2, 3, the auxiliary stack 9 rests relatively flatly on the sheet-carrying surfaces 2, 3 and the surface of the stack of sheets 1. The printed sheets D thus provide little resistance to the sheet-carrying surfaces 2, 3 being inserted. Risk of the printed sheets being pushed together in the inward direction is eliminated since the stability of the auxiliary stack 9 over its two-dimensional extent is now sufficient in order to overcome the forces resulting from the friction between the sheet-carrying surfaces 2, 3 and printed sheets D.

Figure 6:
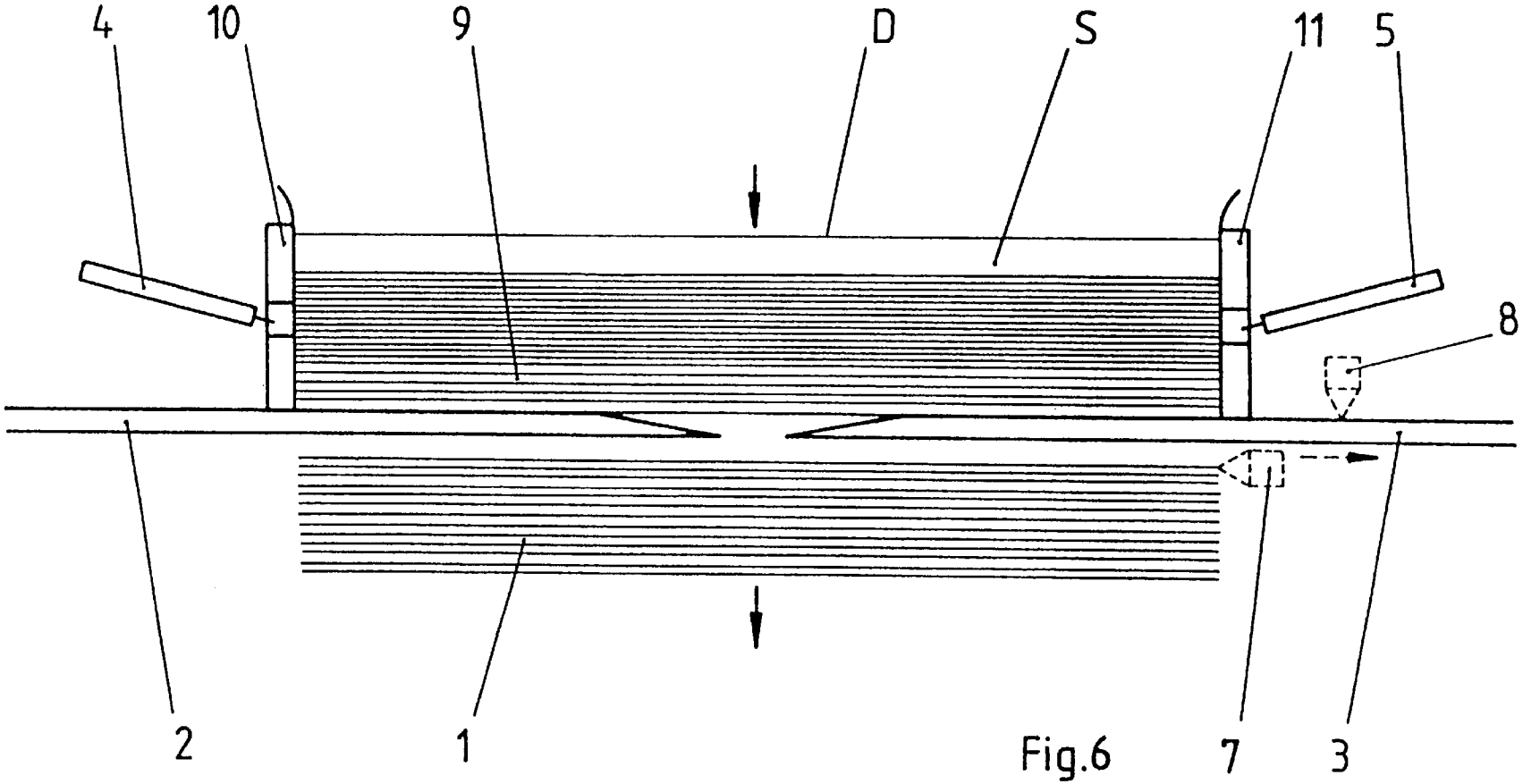

FIG. 6 illustrates the end position of the phase of forming the auxiliary stack in the stack-changing process. Once the sheet-carrying surfaces 2, 3 have been inserted to their full extent from both sides, the printed sheets D of the auxiliary stack 9 then rest completely flatly on the sheet-carrying surfaces 2, 3. At this point in time, the primary stack of sheets 1 can immediately be lowered to the full extent by the main-stack lifting mechanism 13, as shown at 26 in FIG. 9B.

Figure 7:
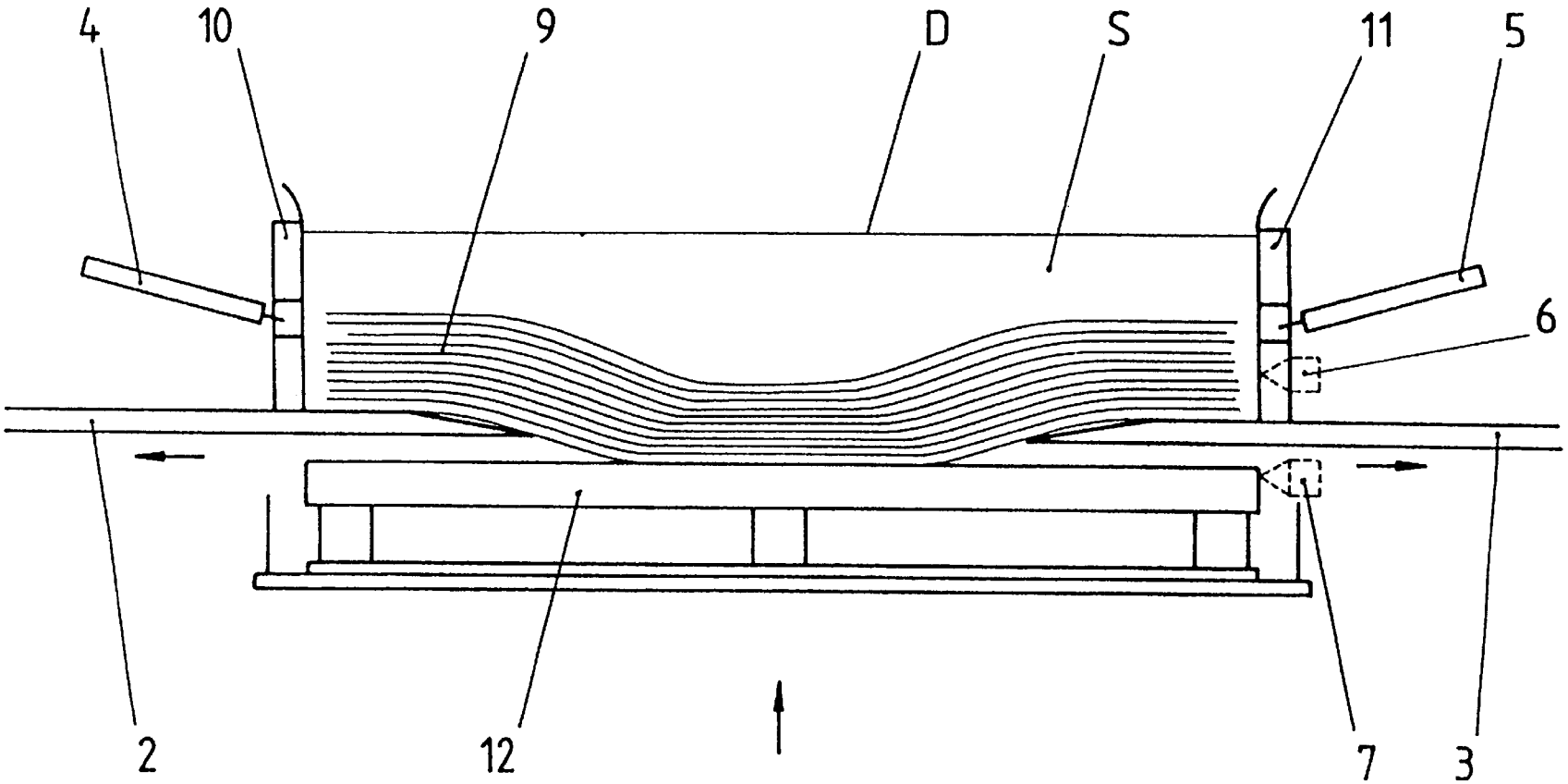
FIG. 7 shows the final phase of receiving the auxiliary stack of the front elevation view of the stack-changing apparatus.

FIG. 7 illustrates the operation for terminating the stack-changing process. Once lowered from the position in the stacking region S, the stack of sheets 1 is removed from the sheet-delivery means and replaced by an empty pallet 12. When the empty pallet 12 has been raised by the main-stack lifting mechanism 13 to beneath the sheet-carrying surfaces 2, 3, said sheet-carrying surfaces 2, 3 are drawn out of the stacking region S in the lateral direction again, as shown by the arrows in FIG. 7 and as shown at 27 in FIG. 9B. In this case, the auxiliary stack 9 falls onto the empty pallet 12 and the sheet-stacking operation can continue as usual. In this arrangement, for example, the sensor 8 or other elements used for the purpose of operational reliability, e.g. limit switches or detectors, detect that the sheet-carrying surfaces 2, 3 have been removed from the stacking region S. Thereafter, the main-stack lifting mechanism 13 can raise the pallet 12 into a position between the lateral guides 10, 11 which is optimum for the task of depositing sheets. This positioning takes place in accordance with the positioning in relation to heights H1 and H2 as the stack of sheets 1 is moved downwards.

The process is supplemented by a corresponding control system 14. The control system, as shown in block diagram form in FIG. 10, contains a memory such as a Random Access Memory RAM 29 which contains the program or sequence of instructions for the control system 14. The control system 14 is a known apparatus in the art of printing and, in particular, for effecting the stack changing. The control system 14 may be implemented as a microprocessor based system or microcontroller based system with appropriately necessary peripheral units to receive the outside inputs and to send commands. The control system 14 thereby receives the inputs from the sensors 6, 7, 8, main-stack lifting mechanism 13, operator input and chain-conveying system and outputs signals to the sheet-carrying surfaces 2, 3, sheet-separating devices 4, 5, and main-stack lifting mechanism 13.

The arrangement of the elements can be seen from FIGS. 1–6. The assignment of the movement operations between the sheet-separating devices 4, 5 and the sheet-carrying surfaces 2, 3, and of the movement of the main-stack lifting mechanism 13 is controlled via sensors 6, 7, 8 in the region of the upper edge of the stack of sheets 1 and in the region of the sheet-carrying surfaces 2, 3. A sensor 6 detects the surface or upper edge of the stack of sheets 1 and thus activates through the control system 14, in a specific position, the thrust-in movement of the sheet-separating devices 4, 5. This should take place when the stack of sheets 1 has been lowered to just beneath the sheet-separating devices 4, 5. As a result, printed sheets D only fall onto the sheet-separating devices 4, 5 once the stack of sheets 1 has already executed part of its lowering movement. Consequently, only a small number of printed sheets D fall onto the sheet-separating devices 4, 5, and the printed sheets D are thus not subjected to such severe treatment in the narrow resting area on the sheet-separating devices 4, 5.

A further sensor 7 is arranged at the intended lower position of the surface or upper edge of the stack of sheets 1 during use of the auxiliary-stack device, this position having been designated as height H2. In this position H2 of the second sensor 7, the stack of sheets 1 is stopped and, at the same time, the sheet-carrying surfaces 2, 3 are set in motion for the purpose of insertion into the region of the stack of sheets 1. The effect of this control system 14 is that a quick transition is achieved for the purpose of inserting the sheet-carrying surfaces 2, 3 and, at the same time, only a small number of printed sheets D come to rest on the sheet-separating devices 4, 5, with the positive results mentioned above. For approaching position H2, it is also possible to derive a signal for a main-stack-lifting-mechanism 13 displacement path which still has to be covered, once the position H1 has been reached, before the downwards movement is brought to a standstill. The sensor 7 therefore acts in conjunction with the main-stack lifting mechanism 13.

Finally, a third sensor 8 is assigned to the sheet-carrying surfaces 2, 3. This sensor 8 detects the insertion movement of the sheet-carrying surfaces 2, 3. The sensor 8 serves to activate the sheet-separating devices 4, 5 and to withdraw the sheet-separating devices 4, 5 once the sheet-carrying surfaces 2, 3 have been inserted beneath the auxiliary stack 9 to such an extent that they can receive the same. When the sheet-separating devices 4, 5 are withdrawn, the printed sheets D positioned on them fall onto the sheet-carrying surfaces 2, 3, located closely above the stack of sheets 1, and thus rest relatively flatly on the stack of sheets 1 and the sheet-carrying surfaces 2, 3. This considerably improves the pushing-in operation of the sheet-carrying surfaces 2, 3 since the printed sheets D of the auxiliary stack 9 are curved, or sag downwards only to a slight extent and provide little resistance when the sheet-carrying surfaces 2, 3 are pushed in. The friction forces are minimized, the two-dimensional extent of the sheets is stabilized, and there are clear force relationships between the sheet-carrying surfaces 2, 3 and printed sheets D of the auxiliary stack 9. Furthermore, as a result, the printed sheets D are no longer moved relative to one another, on the one hand, and, on the other hand, they cannot be pushed together in the inwards direction.

It is shown, in particular, in FIG. 8, in a plan view of the stacking region S, how the sheet-carrying surfaces 2, 3 move in relation to the stack of sheets 1. An illustration is given of the sheet-carrying surfaces 2, 3 on the left and right of the stack of sheets 1 and of the lateral guides 10, 11, which delimit the stacking region S. Particular attention should be paid to the sensor 8, which is fastened on the lateral guide 11 and interacts with the front edge of the sheet-carrying surface 3. The position detected by the sensor 8 is illustrated by dashed lines. It can be seen, in this case, that the sheet-carrying surfaces 2, 3 already extend into the stacking region S and can thus receive the printed sheets D.

It is important, furthermore, that the sensors 6, 7 and 8 are connected to one of the lateral guides 10, 11. This means that the sensors 6, 7, 8 are always positioned correctly in the event of setting to different sheet formats. This ensures that the printed sheets D and/or the stack of sheets 1 is or are always guided reliably and for any format setting and is or are always detected clearly during the stack-changing process.

The operation of the auxiliary stack 9 being received by the sheet-carrying surfaces 2, 3 is thus considerably more reliable, takes place more quickly and produces fewer relative movements between the printed sheets. This reliably avoids the problems of the printing ink marking the underside of printed sheets D lying on top and of printed sheets D consisting of lighter printing materials being pushed together. The operating range of the apparatus is vastly extended in comparison with that which is known.

What is claimed is:

1. Method for changing stacks of sheets in a printing machine having a stacking region, at least two sheet-carrying surfaces, and at least two sheet-separating devices, the method comprising the steps of:

(a) placing sheets in the stacking region to form a primary stack of sheets on a pallet;

(b) lowering the primary stack of sheets when the primary stack of sheets reach a stack height limit;

(c) inserting the at least two sheet-separating devices into the stacking region above the primary stack of sheets, so that a gap is formed between the at least two sheet-separating devices and the primary stack of sheets and so that an auxiliary stack of sheets is formed on top of the at least two sheet-separating devices;

(d) stopping the downward movement of the pallet;

(e) inserting the at least two sheet-carrying surfaces into the stacking region in the gap formed between the at least two sheet-separating devices and the primary stack of sheets so that the auxiliary stack of sheets rests on the at least two sheet-carrying surfaces;

(f) withdrawing the at least two sheet-separating devices;

(g) removing the primary stack of sheets; and (h) withdrawing the at least two sheet-carrying surfaces so that the auxiliary stack of sheets rests on the pallet.

2. The method according to claim 1 wherein the stopping of the downward movement of the pallet is done when the primary stack of sheets are underneath the at least two sheet-carrying surfaces.

3. The method according to claim 1 wherein the at least two sheet-separating devices are withdrawn after a sensor senses the insertion of the at least two sheet-carrying devices.

4. The method according to claim 1 wherein the lowering speed of the primary stack of sheets is increased after insertion of the at least two sheet-separating devices into the stacking region.

5. The method according to claim 1 wherein the removing of the sheets in the stacking region is done after the at least two sheet-carrying surfaces are fully inserted into the stacking region.

6. Method for changing stacks of sheets in a printing machine having a stacking region, at least two sheet-carrying surfaces, and at least two sheet-separating devices, the method comprising the steps of:

(a) placing sheets in the stacking region to form a primary stack of sheets on a pallet which is moving downward;

(b) inserting the at least two sheet-separating devices into the stacking region above the primary stack of sheets when the primary stack of sheets reach a stack height limit, so that a gap is formed between the at least two sheet-separating devices and the primary stack of sheets and so that an auxiliary stack of sheets is formed on top of the at least two sheet-separating devices;

(c) increasing the downward speed of the pallet;

(d) stopping the downward movement of the pallet when the primary stack of sheets are underneath the at least two sheet-carrying surfaces;

(e) inserting the at least two sheet-carrying surfaces into the stacking region in the gap formed between the at least two sheet-separating devices and the primary stack of sheets so that the auxiliary stack of sheets rests on the at least two sheet-carrying surfaces;

(f) withdrawing the at least two sheet-separating devices;

(g) removing the primary stack of sheets; and (h) withdrawing the at least two sheet-carrying surfaces so that the auxiliary stack of sheets rests on the pallet.

7. The method according to claim 6 wherein the primary sheets are removed by lowering the pallet, moving the sheets from the pallet, and raising the pallet.

8. The method according to claim 6 wherein the inserting of the at least two sheet-separating devices into the stacking region is done in a downward fashion.

9. The method according to claim 6 wherein the removing of the sheets in the stacking region is done after the at least two sheet-carrying surfaces are fully inserted into the stacking region.

10. The method according to claim 6 wherein the inserting of the at least two sheet-separating devices into the stacking region is done after a sensor senses that the primary stack of sheets is equal to the stack height limit.

11. The method according to claim 6 wherein after the at least two sheet-separating devices are removed, the auxiliary stack of sheets rests partially on the primary stack of sheets.

12. Apparatus for changing a stack of printed sheets in a stacking region of a printing machine comprising:

a pallet which is situated below the stacking region;

a stack-lifting device connected to the pallet for raising and lowering the pallet;

at least two sheet-separating devices arranged on both sides of the stacking region, the at least two sheet-separating devices capable of being inserted into the stacking region;

at least two sheet-carrying surfaces arranged on both sides of the stacking region and situated below the at least two sheet-separating devices, the at least two sheet-carrying surfaces being substantially horizontal and capable of being inserted into substantially the entire stacking region;

at least two stack height sensors placed on one side of the stacking region for sensing the height of the stack of printed sheets, the first stack height sensor above the second stack height sensor; and a control system electrically connected to the stack-lifting device, the at least two stack height sensors, the at least two sheet-separating devices, and the at least two sheet-carrying surfaces, the control system includes means responsive to the first and second height sensors for (1) increasing the speed of the stack-lifting device after the first stack height sensor senses an absence of sheets and (2) stopping the movement of the stack-lifting device after the second stack height sensor senses an absence of sheets.

13. Apparatus for changing the stack of printed sheets according to claim 12 wherein the second stack height sensor is below the at least two sheet-carrying surfaces.

14. Apparatus for changing the stack of printed sheets according to claim 13 wherein one side of the at least two sheet-carrying surfaces is tapered for insertion under the printed sheets.

15. Apparatus for changing the stack of printed sheets according to claim 12 wherein the at least two sheet-separating devices have pins which can be inserted into the stacking region.

16. Apparatus for changing the stack of printed sheets according to claim 15 wherein the orientation of the at least two sheet-separating devices is slanted with respect to the position of the stack of printed sheets.

* * * * *